US005751324A

United States Patent [19]

Brandon et al.

[11] Patent Number: 5,751,324

[45] Date of Patent: May 12, 1998

[54] INK JET CARTRIDGE BODY WITH VENTED DIE CAVITY

[75] Inventors: Fred Young Brandon, Lexington; Charles Leonard DeCoste, Jr., Richmond; Jan Richard DeMeerleer, Lexington; Michael David Lattuca, Lexington; Jack William Morris, Lexington, all of Ky.

[73] Assignee: Lexmark International, Inc., Lexington, Ky.

[21] Appl. No.: 615,393

[22] Filed: Mar. 14, 1996

[51] Int. Cl.[6] ..... B41J 2/175

[52] U.S. Cl. ..... 347/87

[58] Field of Search ..... 347/20, 40, 50, 347/84, 85, 86, 87, 148, 65

[56] References Cited

U.S. PATENT DOCUMENTS

| | | | |
|---|---|---|---|
| 4,953,287 | 9/1990 | West et al. | 29/611 |
| 4,985,097 | 1/1991 | Matsumura et al. | 156/87 |
| 5,017,947 | 5/1991 | Masuda | 347/65 |
| 5,061,547 | 10/1991 | Plesinger et al. | 428/209 |
| 5,434,607 | 7/1995 | Keefe | 347/50 |
| 5,445,692 | 8/1995 | Nitta | 156/87 |
| 5,537,133 | 7/1996 | Marler et al. | 347/18 |

*Primary Examiner*—Edward Tso

*Attorney, Agent, or Firm*—Ronald K. Aust

[57] ABSTRACT

The invention is directed to an ink jet cartridge assembly, including a cartridge body and a print head. The cartridge body includes a die cavity and at least one groove disposed in communication with the die cavity and with an ambient environment. The print head is disposed at least partially within the die cavity. An adhesive is disposed within the die cavity between the body and the print head for bonding the print head to the body. The at least one groove defines a vent to the ambient atmosphere for a gas which may be produced during curing of the adhesive.

30 Claims, 3 Drawing Sheets

INK JET CARTRIDGE BODY WITH VENTED DIE CAVITY

BACKGROUND OF THE INVENTION

1. Field of the Invention

The present invention relates to an ink jet cartridge assembly, and, more particularly, to an ink jet cartridge assembly including an ink jet cartridge body attached to a print head.

2. Description of the Related Art

An ink jet cartridge assembly of known design typically includes a cartridge body which is attached to a print head assembly (sometimes referred to hereinafter as simply "print head"). Ink which is disposed within the cartridge body flows to the print head and is expelled therefrom in known manner. More particularly, the cartridge body includes a die cavity in which the print head is disposed. The print head is in the form of a semiconductor chip having a nozzle plate attached thereto. A plurality of heater elements are carried by the semiconductor chip, with each heater element being disposed adjacent to a respective nozzle in the nozzle plate. An electrical circuit, which may be in the form of a TAB circuit, electrically interconnects the heater elements with appropriate circuitry in the ink jet printer such that the heater elements may be selectively energized as the carriage of the printer travels across the print medium.

The print head is typically disposed within the die cavity of the cartridge body using an adhesive, such as a heat curable adhesive. During manufacturing, the adhesive is first introduced into the die cavity and the print head is then placed therein. The ink jet cartridge assembly is placed within an oven and the heat curable adhesive is cured at an elevated temperature to permanently affix the print head to the cartridge body. During the curing process, the adhesive may produce gas which forms gas bubbles in the adhesive. Some of the gas may remain entrapped within the adhesive as residual gas bubbles after the curing process is finished. Such gas bubbles, because of the void left in the adhesive, may affect the bond strength between the print head and the cartridge body. Moreover, other gas bubbles may expand at the elevated cure temperature and/or join with adjacent gas bubbles and form passageways or channels within the adhesive. Such a phenomenon, known as "die bond channeling," may result in channels which extend from the ink feed slot within the die cavity to the ambient environment, thereby allowing ink to leak from the ink jet cartridge assembly to the ambient environment. Alternatively, in the case of a multi-color ink jet cartridge assembly, the channels formed in the adhesive may allow cross-contamination between the different color inks.

Additionally, with a conventional ink jet cartridge assembly, the electrical circuit which is used to connect the heater elements of the print head to the printer may be in the form of an electrical circuit carried by a flexible material, commonly known as a Tape Automated Bonding (TAB) circuit. The TAB circuit surrounds the print head and is fastened to the circuit platform of the cartridge body using a pressure sensitive adhesive, also known as a pre-form adhesive. The TAB circuit includes a plurality of beams which extend therefrom and connect with the heater elements on the print head. After the print head is placed within the die cavity and the TAB circuit is attached to the circuit platform, an ultraviolet (UV) photosensitive adhesive is applied along the sides of the print head, over the beams, as an encapsulant and protectant. A light source is applied to the UV adhesive to cure the same.

A portion of the UV adhesive which flows around and behind the beams, or which is otherwise not exposed to the applied light source, is not cured thereby. This uncured UV adhesive is subsequently cured and/or volatilized by the heating process used to cure the heat curable adhesive located in the die cavity and around the print head. During the heat curing process, the heat curable adhesive and/or UV adhesive may produce gas. Because the UV adhesive placed over the beams on each side of the print head has previously been cured, and the TAB circuit is affixed to the circuit platform and surrounds the print head, gas which is produced during the heat curing process may expand (because of the increased temperature) and flow through the heat curable adhesive toward and into the ink feed slot within the die cavity.

U.S. Pat. No. 5,017,947 (Masuda) discloses a print head which is attachable to an ink jet cartridge, and which is used to jet ink droplets onto a print medium. The print head includes a lid which is attached to a support member, with an ink chamber and plurality of nozzles being formed therebetween. A surrounding wall extending from the support member is formed using a photolithography or photoengraving technique to define the ink chamber and nozzles. The lid also includes a thin layer of photosensitive resin which is applied on one side thereof adjacent to the surrounding wall. The photosensitive resin on the lid is pressed together with the photosensitive resin of the upstanding wall and a light source is applied thereto to join the lid together with the support member. As Masuda discloses in FIG. 4, a problem which occurs when joining the lid to the support member of the print head is that residual air pockets are formed within the adhesive when the photosensitive resin of the support member is pressed together with the photosensitive resin on the lid. In an effort to reduce the residual air pockets which are trapped between the two layers of photosensitive resin, Masuda forms a plurality of slots in the corners of the surrounding wall extending from the support member to reduce the overall surface area between the two photosensitive resin layers. That is, reducing the overall surface area between the two photosensitive resin layers in turn reduces the probability of the occurrence of residual air pockets between the two photosensitive layers, thereby reducing the total number of residual air pockets between the two photosensitive resin layers. Thus, Masuda merely addresses the problem of reducing the number of entrapped air bubbles in a print head.

SUMMARY OF THE INVENTION

The present invention provides an ink jet cartridge body with at least one groove which is disposed in communication with the die cavity. The at least one groove vents gas which may be produced during curing of an adhesive disposed within the die cavity to the ambient environment.

The invention comprises, in one form thereof, an ink jet cartridge assembly, including a cartridge body and a print head. The cartridge body includes a die cavity and at least one groove disposed in communication with the die cavity and with an ambient environment. The print head is disposed at least partially within the die cavity. An adhesive is disposed within the die cavity between the body and the print head for bonding the print head to the body. The at least one groove defines a vent to the ambient atmosphere for a gas which may be produced during curing of the adhesive.

An advantage of the present invention is that die bond channeling in the adhesive layer used to mount the print head within the die cavity of the cartridge body is substantially reduced.

Another advantage is that by reducing the die bond channeling through the adhesive, ink flow through such channels to the ambient environment is substantially eliminated.

Yet another advantage is that by reducing the die bond channeling through the adhesive, cross-contamination between different color inks is substantially reduced.

Still another advantage is that gas produced during curing of the adhesive is vented to the outside ambient environment.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
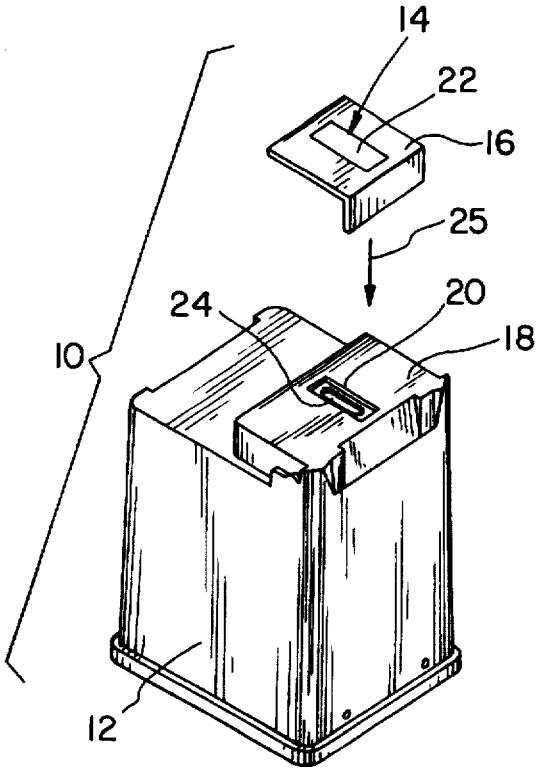
PRIOR ART Fig. 1
FIG. 1 is an exploded, perspective view of a conventional ink jet cartridge assembly.
Figure 2:
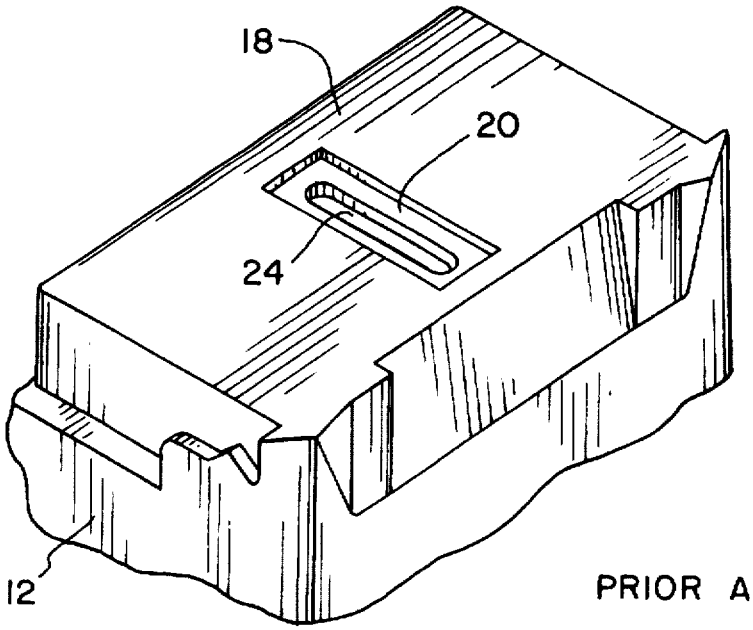
PRIOR ART Fig. 2
FIG. 2 is a fragmentary, perspective view of the ink jet cartridge body shown in FIG. 1, detailing the circuit platform area.

Referring now to the drawings, and more particularly to FIGS. 1 and 2, there is shown an exploded, perspective view of a conventional ink jet cartridge assembly 10 including a cartridge body 12 to which is mounted a print head assembly 14 and electrical circuit 16. More particularly, cartridge body 12 includes a circuit platform 18 with a die cavity 20 extending therefrom. Die cavity 20 is sized such that print head assembly 14 may be disposed therein. In the embodiment shown, die cavity 20 is sized such that the exit side of nozzle plate 22 of print head assembly 14 is disposed substantially coplanar with circuit platform 18. An ink feed slot 24 is disposed in communication with an interior of cartridge body 12, and allows at least one color of ink to flow from the interior of cartridge body 12 to associated nozzles in nozzle plate 22.

Electrical circuit 16 is mounted to cartridge body 12, as indicated by arrow 25, and electrically interconnects print head assembly 14 with a printer (not shown). Electrical circuit 16 is formed from a flexible material, such as Kapton (a trademark of E.I. Dupont de Nemours and Company), in which is disposed a plurality of electrical conductors (not shown) for interconnecting print head assembly 14 with the printer. Electrical circuit 16 may be in the form of a TAB circuit, which will be shown and described in more detail with regard to an embodiment of the present invention shown in section in FIG. 6.

Figure 3:
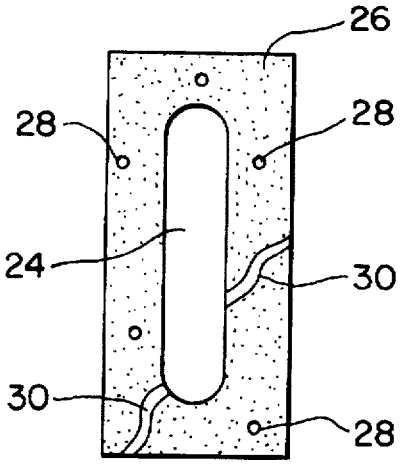
PRIOR ART Fig. 3
FIG. 3 is a top view of a cured adhesive layer used to mount the print head within the die cavity, illustrating typical defects which may occur with the ink jet cartridge assembly shown in FIGS. 1 and 2.

FIG. 3 illustrates defects which may occur in an adhesive 26 which is disposed within die cavity 20 (FIGS. 1 and 2) and used to bond print head assembly 14 to cartridge body 12. In the embodiment shown, adhesive 26 is in the form of a heat curable adhesive, and the defects shown in FIG. 3 are those which are present in adhesive 26 after the heat curing process takes place. After the heat curing process, adhesive 26 may include residual air bubbles 28 therein. Air bubbles 28 typically do not cause a problem when entrapped within adhesive 26. On the other hand, adhesive 26 may also include one or more die bond channels 30 which extend therethrough and are disposed in communication with a feed slot 24 and the ambient environment. Channels 30 are undesirable since they may allow ink to flow from the interior of cartridge body 12 to the ambient environment. Alternatively, in the event that ink jet cartridge assembly 10 is in the form of a multi-color cartridge assembly, channels 30 may allow cross-contamination between the different color inks.

Channels 30 are believed to be caused by the thermal expansion of air bubbles 28 during the heat curing process of adhesive 26, and/or the joining together of a number of air bubbles 28 during the curing process. Moreover, it is also known, as will be described in more detail hereinafter, to place a photosensitive (UV) adhesive between print head assembly 14 and TAB circuit 16. A portion of the UV adhesive which is not cured when exposed to light may likewise produce gas during the heat curing cycle of adhesive 26, and thereby contribute to the formation of channels 30.

Figure 4:
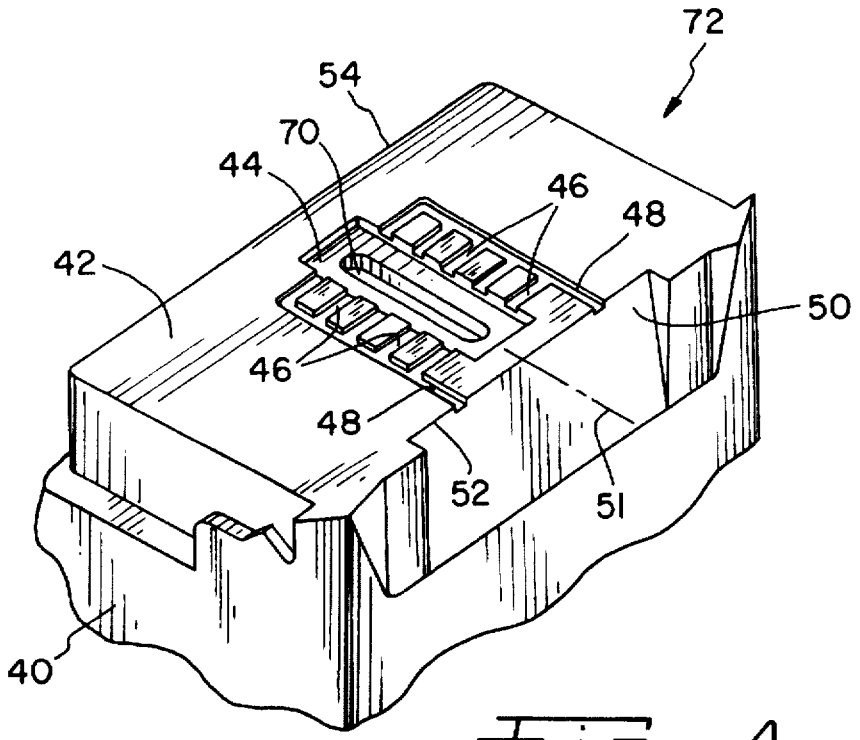
FIG. 4 is a fragmentary, perspective view of an embodiment of an ink jet cartridge body of the present invention, detailing the circuit platform area.
Figure 5:
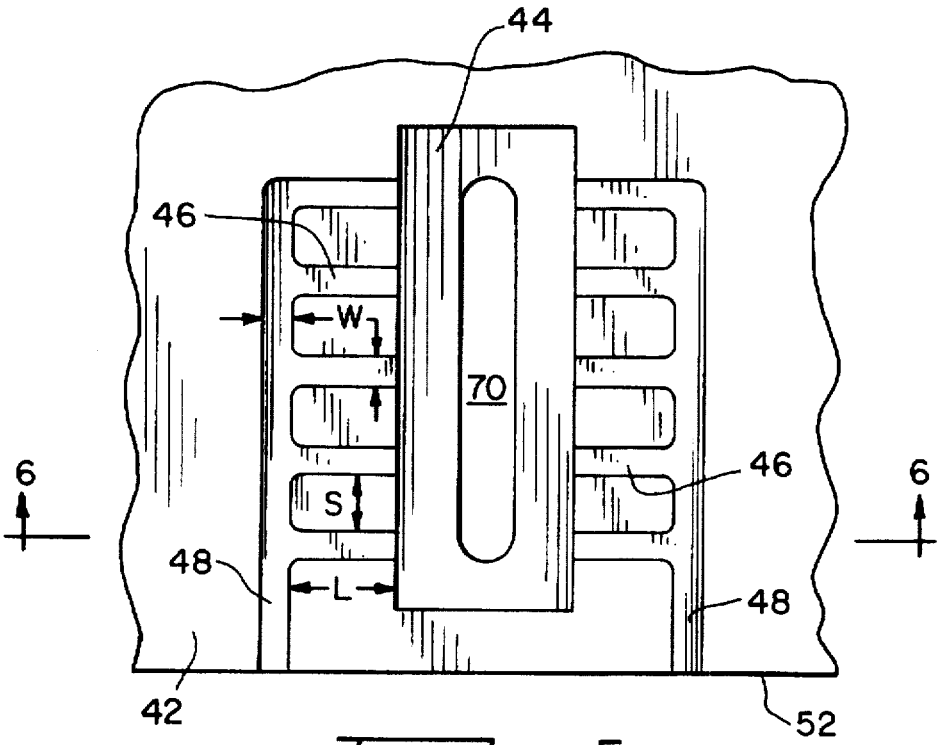
FIG. 5 is an enlarged view of the circuit platform area shown in FIG. 4.
Figure 6:
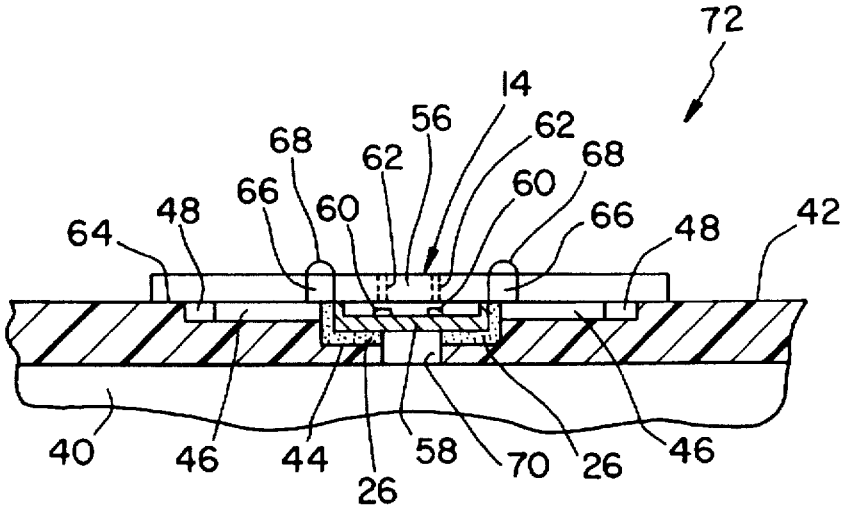
FIG. 6 is an enlarged, sectional view taken along line 6—6 in FIG. 5 and includes a partial sectional side view of a print head assembly and circuit.

FIGS. 4–6 illustrate one embodiment of a cartridge body 40 of the present invention. Cartridge body 40 includes a circuit platform 42 and die cavity 44 to which a TAB circuit 16 and print head assembly 14 may be respectively attached. However, in contrast with cartridge body 12 shown in FIGS. 1 and 2, cartridge body 40 includes a plurality of grooves 46, 48 which are disposed in communication with die cavity 44 and with an ambient environment. Grooves 48 define at least one longitudinal groove (extending substantially parallel to a longitudinal direction of die cavity 44 along longitudinal axis 51), and grooves 46 define a plurality of lateral grooves extending between die cavity 44 and longitudinal grooves 48. Longitudinal grooves 48 extend to an edge 50 disposed adjacent to the ambient environment. TAB circuit 16 wraps around a corner 52 of cartridge body 40 in a relatively loose manner such that longitudinal grooves 48 remain in communication with the ambient environment. However, it will also be appreciated that longitudinal grooves 48 may just as easily extend to another corner of circuit platform 42, such as corner 54.

Referring now to FIG. 5, grooves 46, 48 have dimensions corresponding to the dimensions represented by the reference letters W, S and L. The dimension W is preferably between 0.15 and 0.75 mm, and more preferably between 0.2 and 0.3 mm. The dimension S is preferably between 0.75 and 2.5 mm, and more preferably between 1 and 2 mm. The dimension L is preferably between 0.5 and 4.0 mm, and more preferably between 1.5 and 2.5 mm. Further, grooves 46, 48 have a depth (substantially perpendicular to the drawing in FIG. 5) which is preferably between 0.1 and 0.5 mm, and more preferably between 0.25 and 0.35 mm.

With reference to FIG. 6, gas which is produced during the curing of an adhesive and subsequently vented to the ambient environment through the use of the present invention will be described in more detail. Print head assembly 14 includes a nozzle plate 56 which is attached to a semiconductor chip 58. Semiconductor chip 58 includes a plurality of heater elements 60 which are disposed adjacent to respective nozzles 62 in nozzle plate 56. Heater elements 60 are actuated in known manner to jet droplets of ink from nozzles 62 and on to a print medium.

Print head assembly 14 is disposed at least partially within die cavity 44. A heat curable adhesive 26 is disposed within die cavity 44 between cartridge body 40 and print head assembly 14 for bonding print head assembly 14 to cartridge body 40.

TAB circuit 16 substantially surrounds the sides and ends of print head assembly 14, and is attached to circuit platform 42 using a suitable adhesive, such as a pre-form adhesive 64. TAB circuit 16 thus overlies the plurality of grooves 46, 48 formed in circuit platform 42. TAB circuit 16 is electrically connected to print head assembly 14 using a plurality of conductive beams 66. More particularly, beams 66 electrically interconnect respective heater elements 60 with electrical conductors (not shown) within TAB circuit 16. The electrical conductors within TAB circuit 16 are connected to suitable circuitry within the printer (not shown) upon insertion of cartridge body 14 into the printer. A bead of UV adhesive 68 is placed along each side of print head assembly 14 after TAB circuit 16 is attached to circuit platform 42, and acts as an encapsulant to protect beams 66 from physical damage. UV adhesive 68 which is applied along each side of print head assembly 14 is cured upon exposure to a light source; however, a small amount of UV adhesive 68 which flows around beams 66 or slightly under TAB circuit 16 may not be cured upon application of the light source because of the lack of UV light exposure therewith.

Heat curable adhesive 26 and the portion of uncured UV adhesive 68 both may produce gas during the heat curing cycle necessary to cure heat curable adhesive 26. Without the provision of lateral grooves 46 and longitudinal grooves 48, it will be appreciated that any such gas produced by heat curable adhesive 26 and/or UV adhesive 68 during the heat curing cycle must flow toward ink feed slot 70 since TAB circuit 16 and the cured UV adhesive 68 define an effective seal at circuit platform 42. Grooves 46, 48 define an effective vent for venting gas produced during the heat curing cycle to the ambient environment without the formation of die bond channels 30 in adhesive 26.

The manufacture of ink jet cartridge assembly 72 will now be described. First, a cartridge body 40 including a circuit platform 42 and die cavity 44 of known design are formed. At least one groove 46, 48, and preferably a plurality of grooves 46, 48, are formed in circuit platform 42, with each groove 46, 48 being disposed in communication with die cavity 44. In the embodiment shown in FIGS. 4–6, circuit platform 42 includes an edge 50, and grooves 46, 48 are disposed in communication with each of die cavity 44 and edge 50. A pre-form adhesive 64 is then applied to circuit platform 42, and a heat curable adhesive 26 is placed into die cavity 44. TAB circuit 16 and print head assembly 14 (which are connected together via beams 66) are then attached to cartridge body 40 such that print head assembly 14 is disposed within die cavity 44 and TAB circuit 16 overlies grooves 46, 48. A bead of UV adhesive 68 is then applied down each side of print head assembly 14 as an encapsulant to protect beams 66. A light source is then applied to UV adhesive 68 to cure portions of UV adhesive 68 coming in contact therewith. Ink jet cartridge assembly 72 is then placed within an oven (not shown) to cure heat curable adhesive 26. Gas which is produced by heat curable adhesive 26 and/or UV adhesive 68 during the heat curing process is vented to the ambient environment using lateral grooves 46 and longitudinal grooves 48. Such venting of gas produced during the heat curing cycle inhibits die bond channeling within heat curable adhesive 26.

Figure 7:
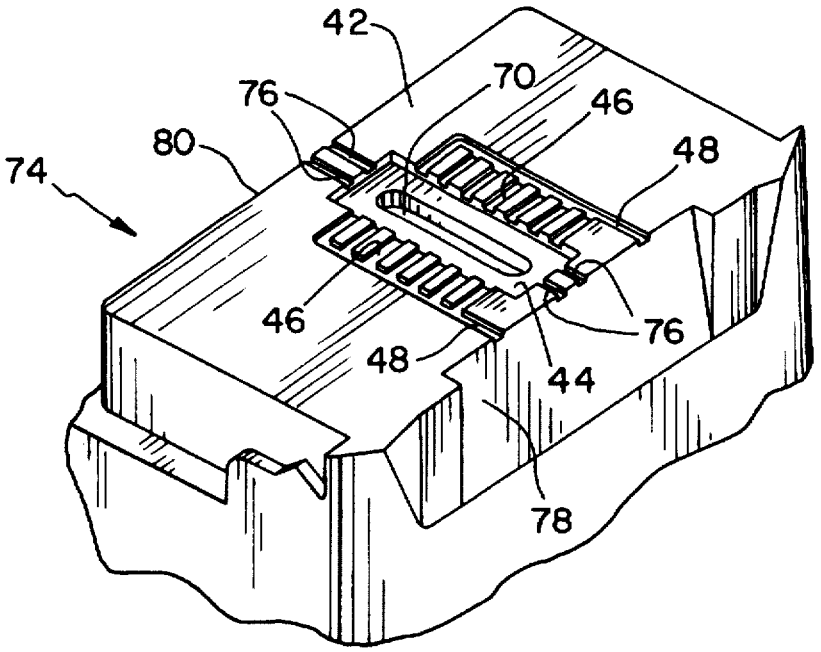
FIG. 7 is a fragmentary, perspective view of another embodiment of an ink jet cartridge body of the present invention, detailing the circuit platform area.

FIG. 7 illustrates another embodiment of an ink jet cartridge body 74 of the present invention. Cartridge body 74 includes a circuit platform 42, die cavity 44, lateral grooves 46, and longitudinal grooves 48 similar to the embodiment of ink jet cartridge body shown in FIGS. 4–6. In addition, ink jet cartridge body 74 includes longitudinal grooves 76 extending from each end of die cavity 44 to respective edges 78, 80.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ink jet cartridge assembly, comprising:

a cartridge body including a die cavity, said body further including at least one groove disposed in communication with said die cavity and with an ambient environment;

a print head disposed at least partially within said die cavity; and an adhesive disposed within said die cavity between said body and said print head for bonding said print head to said body;

wherein said at least one groove defines a vent to the ambient atmosphere for a gas which may be produced during curing of said adhesive.

2. The ink jet cartridge assembly of claim 1, further comprising an electrical circuit carried by a flexible material, said electrical circuit disposed adjacent to said at least one groove.

3. The ink jet cartridge assembly of claim 2, wherein said electrical circuit comprises a tape automated bonding circuit.

4. The ink jet cartridge assembly of claim 1, wherein said adhesive comprises a heat curable adhesive.

5. The ink jet cartridge assembly of claim 1, wherein said at least one groove comprises a plurality of grooves.

6. The ink jet cartridge assembly of claim 5, wherein said die cavity has a longitudinal direction, and wherein said plurality of grooves comprise a plurality of lateral grooves and at least one longitudinal groove.

7. The ink jet cartridge assembly of claim 6, wherein said at least one longitudinal groove comprises a plurality of longitudinal grooves.

8. The ink jet cartridge assembly of claim 1, wherein said print head comprises a semiconductor chip having a plurality of heater elements thereon, and a nozzle plate disposed over said heater elements.

9. The ink jet cartridge assembly of claim 8, further comprising a plurality of beams, each said beam connected to a respective one of said heater elements.

10. The ink jet cartridge assembly of claim 9, further comprising an electrical circuit carried by a flexible material, said electrical circuit disposed adjacent to said at least one groove, each said beam also being connected to said electrical circuit.

11. The ink jet cartridge assembly of claim 10, further comprising a photosensitive adhesive disposed at least partially around said beams for encapsulating said beams.

12. An ink jet cartridge, comprising a cartridge body including a circuit platform with a die cavity extending therefrom, said circuit platform including at least one edge, said body further including at least one groove disposed in said circuit platform, at least one said groove being in communication with each of said die cavity and one said edge.

13. The ink jet cartridge of claim 12, wherein said at least one groove comprises a plurality of grooves.

14. The ink jet cartridge of claim 13, wherein said die cavity has a longitudinal direction, and wherein said plurality of grooves comprise a plurality of lateral grooves and at least one longitudinal groove.

15. The ink jet cartridge of claim 14, wherein said at least one longitudinal groove comprises a plurality of longitudinal grooves.

16. The ink jet cartridge of claim 14, wherein said plurality of lateral grooves have dimensions W, S and L, said dimension W representing a width of each of said plurality of lateral grooves and said at least one longitudinal groove, said dimension S representing a spacing between adjacent ones of said plurality of lateral grooves, and said dimension L representing a length of said plurality of lateral grooves, said dimension W being between 0.15 and 0.75 mm, said dimension S being between 0.75 and 2.5 mm, and said dimension L being between 0.5 and 4.0 mm.

17. The ink jet cartridge of claim 16, wherein said dimension W is between 0.2 and 0.3 mm, said dimension S is between 1 and 2 mm, and said dimension L is between 1.5 and 2.5 mm.

18. A method of manufacturing an ink jet cartridge assembly, comprising the steps of:

providing a cartridge body including a circuit platform with a die cavity extending therefrom; and forming at least one groove in said circuit platform, each said at least one groove disposed in communication with said die cavity.

19. The method of claim 18, wherein said forming step comprises forming a plurality of grooves in said circuit platform.

20. The method of claim 18, wherein said circuit platform includes an edge, and wherein said forming step comprises forming at least one said groove which is in communication with each of said die cavity and said edge.

21. The method of claim 20, wherein each said groove is disposed in communication with each of said die cavity and said edge.

22. The method of claim 20, comprising the further step of introducing an adhesive into said die cavity.

23. The method of claim 22, comprising the further step of placing a print head at least partially within said die cavity, said print head being in contact with said adhesive.

24. The method of claim 23, comprising the further step of heat curing said adhesive.

25. The method of claim 24, comprising the further step of venting a gas produced during said curing step from said adhesive into at least one said groove and to an ambient atmosphere.

26. The method of claim 18, comprising the further steps of:

providing an electrical circuit carried by a flexible material; and mounting said electrical circuit to said circuit platform adjacent to said at least one groove.

27. The method of claim 26, wherein said electrical circuit comprises a tape automated bonding circuit.

28. An ink jet cartridge assembly, comprising:

a cartridge body including a die cavity, said body further including at least one groove disposed in communication with said die cavity and with an ambient environment;

a print head disposed at least partially within said die cavity; and an adhesive disposed adjacent to each of said print head and said body;

wherein said at least one groove defines a vent to the ambient atmosphere for a gas which may be produced during curing of said adhesive.

29. The ink jet cartridge assembly of claim 28, wherein said adhesive comprises a heat curable adhesive.

30. The ink jet cartridge assembly of claim 28, wherein said adhesive comprises a photosensitive adhesive.

* * * * *